US009770670B2

(12) United States Patent
Fierbaugh

(10) Patent No.: US 9,770,670 B2
(45) Date of Patent: Sep. 26, 2017

(54) ADJUSTABLE HURDLE

(71) Applicant: Randy Fierbaugh, Palm Harbor, FL (US)

(72) Inventor: Randy Fierbaugh, Palm Harbor, FL (US)

( * ) Notice: Subject to any disclaimer, the term of this patent is extended or adjusted under 35 U.S.C. 154(b) by 192 days.

(21) Appl. No.: 14/503,432

(22) Filed: Oct. 1, 2014

(65) Prior Publication Data

US 2016/0096121 A1 Apr. 7, 2016

(51) Int. Cl.
*A63B 21/00* (2006.01)
*A63K 3/04* (2006.01)

(52) U.S. Cl.
CPC ..... *A63K 3/043* (2013.01)

(58) Field of Classification Search
CPC ..... A63B 21/00
USPC ..... 482/15, 16; 15/15, 16
See application file for complete search history.

(56) References Cited

U.S. PATENT DOCUMENTS

| | | | | |
|---|---|---|---|---|
| 615,443 | A | 12/1898 | Foster | |
| 974,613 | A | 11/1910 | Tothill | |
| 1,013,386 | A | 1/1912 | Gilkey | |
| 2,191,253 | A | 5/1939 | Hanke | |
| 2,677,544 | A | 6/1950 | Desselman | |
| 5,033,737 | A | 7/1991 | Moye | |
| 5,334,119 | A | 8/1994 | Eloranta | |
| 5,334,121 | A | 8/1994 | McPhilomy | |
| 6,416,447 | B1 | 7/2002 | Harmon | |
| 6,475,116 | B2 | 11/2002 | Chen Wu | |
| 7,666,119 | B1 * | 2/2010 | Jhang | A63K 3/043 482/23 |
| 7,785,233 | B1 | 8/2010 | Moore | |
| 8,075,425 | B2 | 12/2011 | Conwright | |

* cited by examiner

*Primary Examiner* — Jerome w Donnelly
(74) *Attorney, Agent, or Firm* — Larson & Larson, P.A.; Justin P. Miller; Patrick A. Reid

(57) ABSTRACT

Two or more hurdle loops of varying heights connect to a horizontal crossbar by a rotatable interface. The horizontal crossbar is supported by legs that each end in base. Each hurdle loop has an upright and collapsed position, to provide adjustable height settings for use in physical activities.

13 Claims, 4 Drawing Sheets

ADJUSTABLE HURDLE

FIELD

This invention relates to the field of sporting goods and more particularly to an adjustable height hurdle.

BACKGROUND

Hurdles are often employed in the field of sports and recreation for the purpose of promoting physical activity, namely running and jumping over the hurdle. Most often, hurdles are manufactured to provide a fixed height for jumping. Fixed heights cater to a limited group, leaving out others in the wide spectrum of physical capabilities.

SUMMARY

The Adjustable Hurdle is a device that provides several easily adjustable height settings for use in physical activities. By rotating hurdle loops of various sizes between their collapsed and upright positions, the user can change the height of the hurdle. Thus, the hurdle device can be used with a wider range of physical capabilities than a standard hurdle.

The hurdle loops can be characterized in many ways. For example, as loops, whether continuous or discontinuous. Or the hurdle loops may be referred to as circles, rings, bangles, hoops, ribs, bands, and so forth.

The hurdle loops fit within each other in a nesting arrangement, with the larger loops encircling/encompassing/surrounding the smaller loops.

A lightweight material for construction reduces risk of injury as compared to standard metal hurdles by tipping over more readily.

The main components of the Adjustable Hurdle are the legs, supporting a horizontal crossbar, which in turn supports multiple hurdle loops. The combination of the legs, horizontal crossbar, and base constitutes the frame. The multiple hurdle loops allow a user to choose one of many different hurdle heights. The hurdle heights are achieved by choosing one or more hurdle loops and rotating the loop or loops to the upright position. The use of different sized loops results in different hurdle heights.

The hurdle loops collapse into one another, with the smaller sizes nesting within the larger sizes. The outer hurdle loop is the largest, with each subsequent loop being of a smaller size, allowing the subsequent loops to fit within preceding loops.

The hurdle loops pivot about the horizontal crossbar. Each hurdle loop is rotatably interfaced to the horizontal crossbar.

In its primary embodiment, the hurdle loops of the Adjustable Hurdle are held in place by friction at the sliding connection between the hurdle loops and the horizontal crossbar. But other mechanisms of allowing for rotational movement in combination with optional fixed positions are anticipated. For example, rotational movement may be achieved by providing a bushing or bearing between a given hurdle loop and the horizontal crossbar. Or a hurdle loop can be fixed at a given position using a ratcheting mechanism with, or separate from, the bushing or bearing. A ratcheting mechanism allows each hurdle look to index to one or more positions, depending upon the design. For example, the ratcheting mechanism may lock the hurdle loop in an upright position, and other positions 90 degrees separated from upright. Or the ratcheting mechanism may only lock in the upright and collapsed positions.

Or a compression mechanism may work in combination with the bushing or bearing to maintain position, e.g., a thumb screw with a threaded penetration, allowing the tip of the thumb screw to bear against the horizontal crossbar or bushing/bearing.

Each hurdle loop has two primary positions: upright and collapsed. In the upright position the hurdle loop is in a vertical position, above the horizontal crossbar. In the collapsed position the hurdle loop is also in a vertical position, but below the horizontal crossbar.

The result is that a single Adjustable Hurdle includes one height when all hurdle loops are collapsed, and an additional height for each hurdle loop that is set upright. Thus, for example, if the Adjustable Hurdle includes two loops, there are three potential heights a user can choose.

The hurdle loops are also positionable at locations between upright and collapsed. This may be useful for exercises where a greater hurdle width, rather than merely hurdle height, is desirable. Given that each hurdle loop is independent, the result is that if the Adjustable Hurdle includes three hurdle loops, a hurdle loop is simultaneously positionable at the front, top, and back.

The horizontal crossbar is held above the ground by the legs. The legs are shown as vertical members, but many other types of legs are possible. A triangular leg may substitute, which by virtue of its flat lower portion includes a base. Similarly, a square may be substituted for legs, also including a base by virtue of its shape.

At the end of the legs is a base. In the preferred embodiment, the base is two separate extensions of equal, or nearly equal, length. Additionally, each side of the base is preferably shorter than the overall height of the Adjustable Hurdle. This is useful because when the Adjustable Hurdle is used for side-to-side exercises, a user may catch her foot on the Adjustable Hurdle. If so, it is important that the Adjustable Hurdle tip over, rather than trip the user.

As discussed above, certain shapes avoid the need for including separate extensions from the leg, and instead include the base within their shape. Shapes such as triangles, squares, rectangles, and so forth, include flat portions that function as bases.

The Adjustable Hurdle is preferably constructed of a hollow material of low density to keep weight down. For example, hollow plastic pipe, certain types of wood, composite materials such as fiberglass or carbon fiber, or low-density metals such as aluminum. While the Adjustable Hurdle can be made of dense materials, it is less preferable because a heavy hurdle is difficult to tip, and thus more likely to cause injury to the user.

There are many exercises that a single Adjustable Hurdle may be used to perform. For example, CrossFit type exercises, such as side-to-side hops, or laterals.

With two or more Adjustable Hurdles, a user may perform the following example exercises: the side step, where the user steps sideways over a series of hurdles; the crossover, where the user runs with the body oriented at an angle, stepping over a hurdle at each step; or conventional hurdles, where the user jumps over the hurdle while running directly perpendicular to the Adjustable Hurdle.

Furthermore, the easily adjustable height of the Adjustable Hurdle makes it ideal for physical therapy. For example, if the Adjustable Hurdle is being used to help a patient with his step height, when the therapist wishes to increase the height of the Adjustable Hurdle, it requires only a simple rotation of a hurdle loop.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
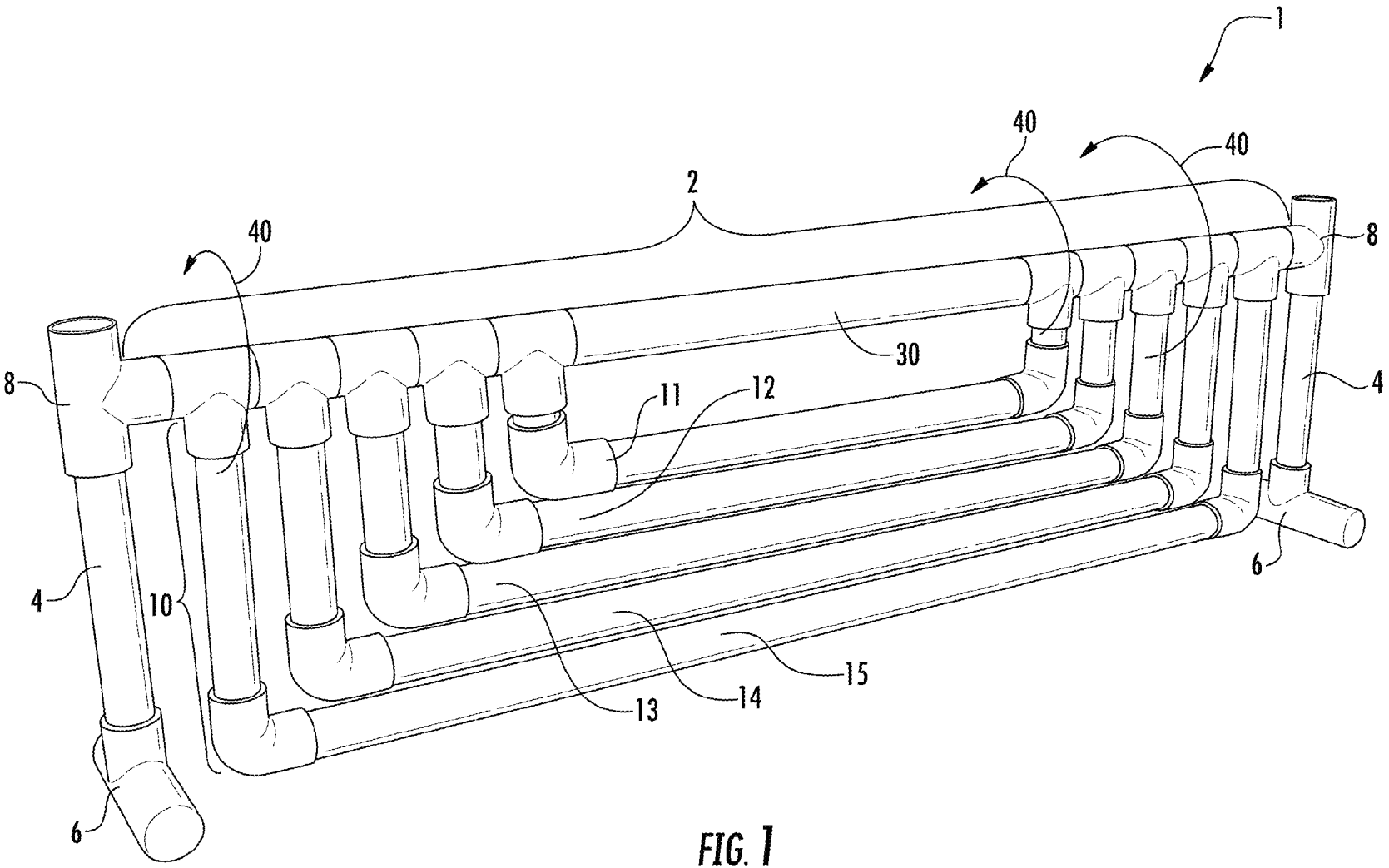
FIG. 1 illustrates an isometric view of the Adjustable Hurdle, showing a first embodiment with five hurdle loops.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an isometric view of the Adjustable Hurdle 1 is shown. The Adjustable Hurdle 1 loop of FIG. 1 includes the horizontal crossbar 2, in turn connected to the corner joint 8, supported by legs 4, each of the legs 4 with a base 6.

The hurdle loops 10 include first hurdle loop 11, second hurdle loop 12, third hurdle loop 13, fourth hurdle loop 14, and fifth hurdle loop 15. Potential directions of rotation are shown as 40.

Figure 2:
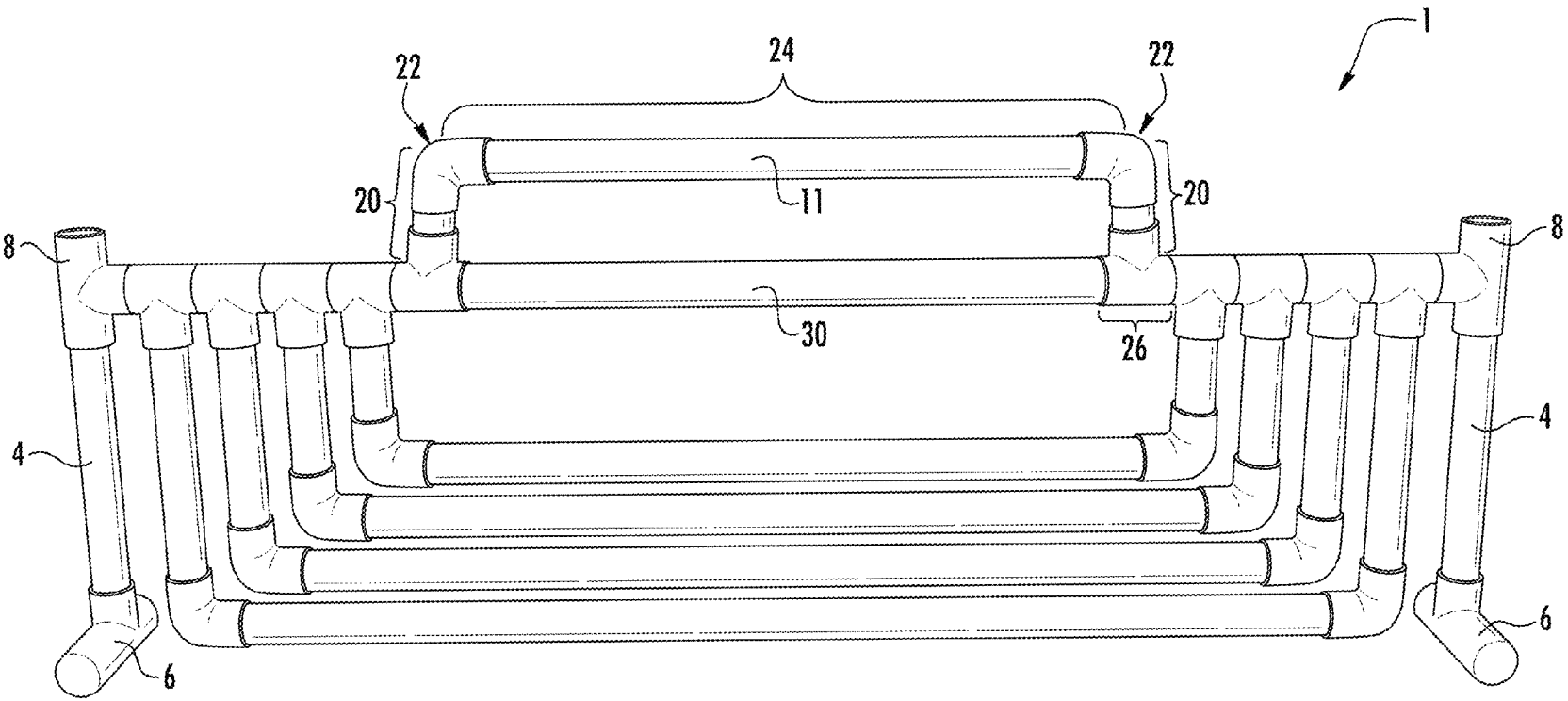
FIG. 2 illustrates a front view of the first embodiment of the Adjustable Hurdle, with one loop in the upright position and a total of five hurdle loops.

Referring to FIG. 2, a front view of the Adjustable Hurdle 1 is shown. In FIG. 2, the first hurdle loop 11 is in the upright position. Using the first hurdle loop as an illustration of a typical hurdle loop, the parts are as follows:

Each hurdle loop includes hurdle loop vertical legs 20, hurdle loop elbows 22, and a hurdle loop horizontal beam 24. The hurdle loop vertical legs 20 are connected to the horizontal crossbeam 2 by a hurdle loop rotatable interface 26.

The Adjustable Hurdle 1 optionally includes a center spacer 30, which prevents any of the hurdle loops 10 from shifting left to right by maintaining space in the center of the horizontal crossbar 2.

FIG. 2 shows an embodiment of the Adjustable Hurdle 1 set to its second lowest position. The lowest position is with all hurdle loops 10 in a collapsed position, and the horizontal crossbar 2 being the highest point of the Adjustable Hurdle 1.

Figure 3:
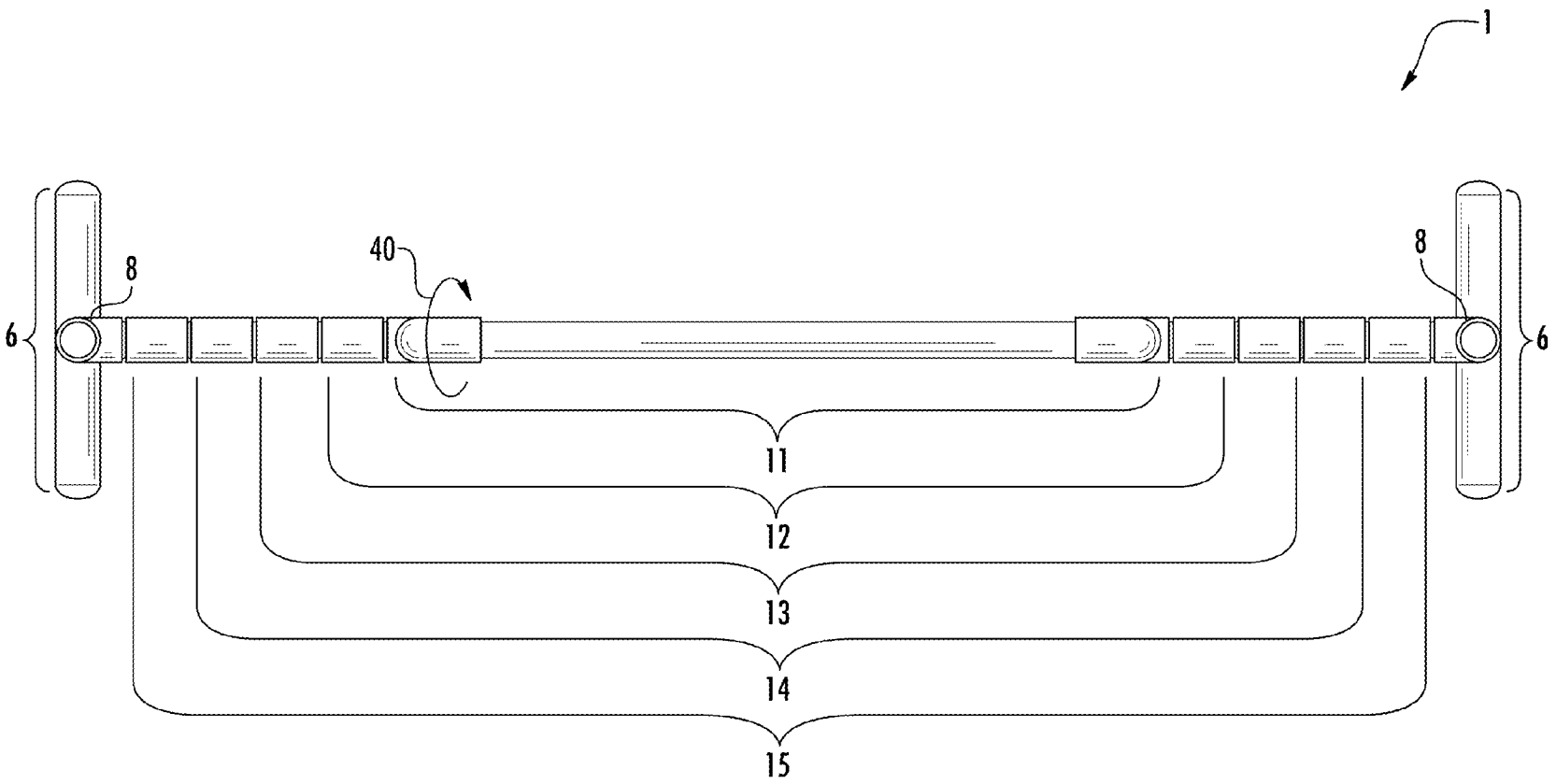
FIG. 3 illustrates a top view of the first embodiment of the Adjustable Hurdle, with one loop in the upright position of a total of five hurdle loops.

Referring to FIG. 3, a top view of the Adjustable Hurdle is shown. As in FIG. 2, one loop is in the upright position. This is the view a user will see during use of the Adjustable Hurdle 1. The relatively narrow base 6 is shown, illustrating how the Adjustable Hurdle 1 will tip over rather than trip a user. The narrow profile of the Adjustable Hurdle 1 is also shown. As an alternative to the having all hurdle loops 10 coplanar and vertical, as shown, one or more hurdle loops 10 may be partially folded out. This will increase with effective width of the Adjustable Hurdle 1.

Figure 4:
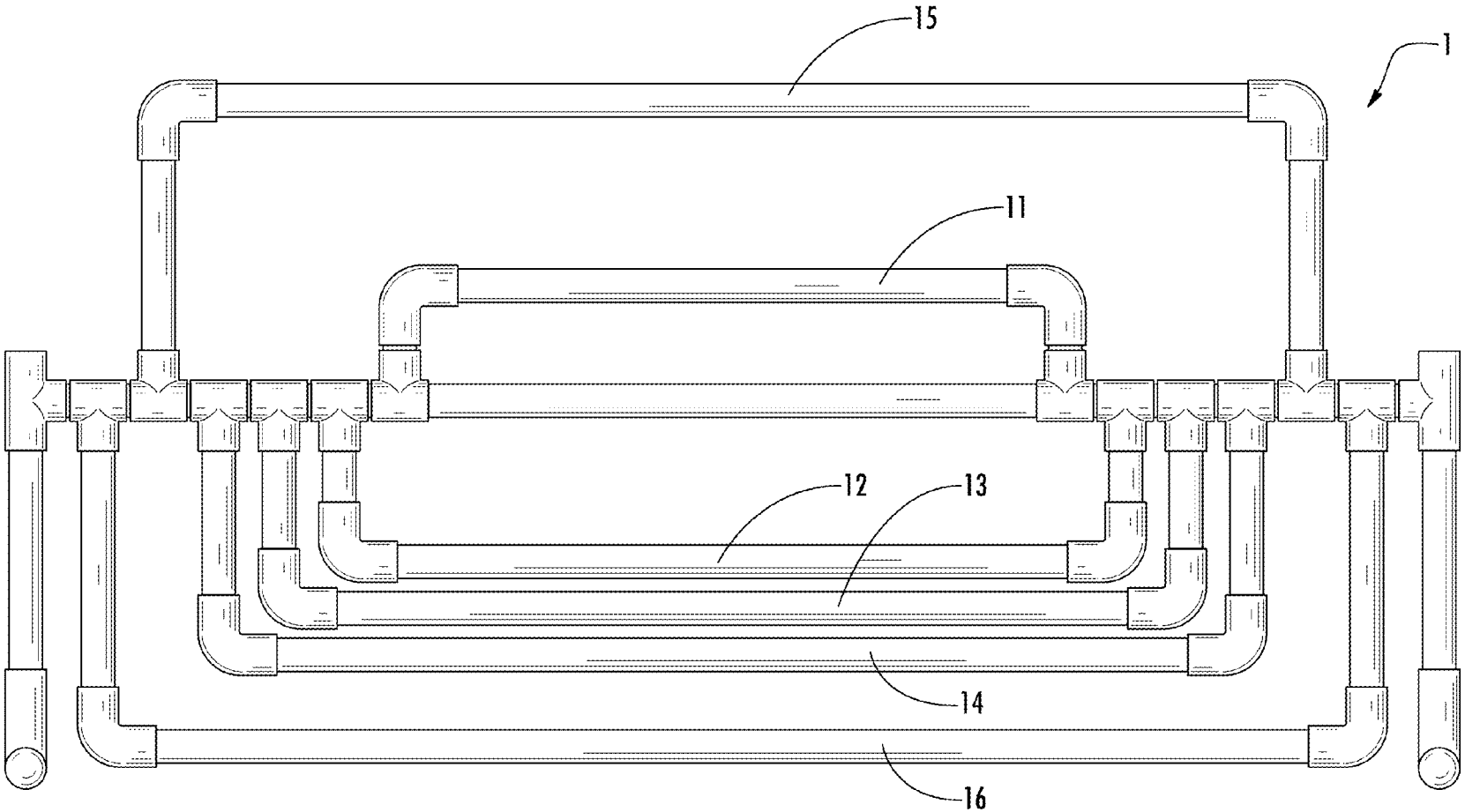
FIG. 4 illustrates a front view of the Adjustable Hurdle, showing two hurdle loops in the upright position, with a total of six hurdle loops.

Referring to FIG. 4, a front view of the Adjustable Hurdle 1 is shown. In FIG. 4, two hurdle loops are in the upright position, and the Adjustable Hurdle 1 includes the sixth hurdle loop 16, for a total of six hurdle loops 10.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A hurdle device comprising:

a. a plurality of hurdle loops of varying heights; and b. a plurality of hurdle loop rotatable interfaces that each create a rotating connection between the plurality of hurdle loops and a horizontal crossbar;

c. wherein each hurdle loop has a collapsed position and an upright position, and each hurdle loop is independently rotatable between its collapsed position and its upright position; and d. wherein the hurdle loops have a nesting arrangement, surrounding one-another when in the collapsed position; and e. wherein the plurality of hurdle loops rotate about a crossbar; and f. wherein the plurality of hurdle loop rotatable interfaces is a sliding connection that maintains a position of the plurality of hurdle loops using a ratcheting mechanism with specific indexed positions.

2. The hurdle device of claim 1, further comprising:

a. one or more legs, wherein each of the one or more legs interfaces to the crossbar; and b. one or more bases, wherein each of the one or more bases attaches to one of the one or more legs.

3. The hurdle device of claim 1, wherein each of the plurality of hurdle loops is held in its collapsed position or upright position by friction.

4. The hurdle device of claim 3, further comprising:

a. a crossbar, wherein the plurality of hurdle loops rotate about the crossbar, and b. wherein the friction holding each hurdle loop in a position is caused by contact between each of the plurality of hurdle loops and the crossbar.

5. The hurdle device of claim 1, wherein the plurality of hurdle loop rotatable interfaces is a sliding connection that maintains a position of the plurality of hurdle loops using friction.

6. A hurdle comprising:

a. a crossbar;

b. two or more legs interfaced to the crossbar;

c. a first hurdle loop interfaced to the crossbar; and d. a second hurdle loop interfaced to the crossbar, wherein the first hurdle loop rotates independently and within the second hurdle loop; and e. wherein there is no position at which the second hurdle loop collides with the first hurdle loop; and f. wherein the hurdle loops maintain a position chosen by a user using a ratcheting mechanism with specific indexed positions.

7. The hurdle of claim 6, wherein the hurdle loops maintain a position chosen by a user using friction.

8. The hurdle of claim 6, wherein the hurdle loops interface to the crossbar by means of a sliding connection.

9. The hurdle of claim 6, wherein the first hurdle loop and the second hurdle loop have an upright position and a collapsed position.

10. The hurdle of claim 9, wherein when in the upright position and the collapsed position, the hurdle loops are vertical.

11. The hurdle of claim 9, wherein the first hurdle loop and second hurdle loop can maintain positions between the upright and collapsed positions.

12. A hurdle comprising:

a. a horizontal crossbar attached to two legs, each leg having a base;

b. a plurality of hurdle loops rotatably interfaced to the horizontal crossbar;

c. where each hurdle loop includes two vertical legs and one horizontal beam;

d. wherein the vertical legs and horizontal beam of each hurdle loop is of a different dimension that than of each other hurdle loop, allowing each hurdle loop to rotate within the other hurdle loops; and e. wherein each of the plurality of hurdle loops can maintain a position using a ratcheting mechanism with specific indexed positions.

13. The hurdle of claim 12, wherein each of the plurality of hurdle loops can maintain a position using friction.

* * * * *